US005728415A

United States Patent [19]

Troska

[11] Patent Number: 5,728,415

[45] Date of Patent: Mar. 17, 1998

[54] PRIZE-CONTAINING BEVERAGE CAN

[75] Inventor: Georg Troska, Herten, Germany

[73] Assignee: The Coca-Cola Company, Atlanta, Ga.

[21] Appl. No.: 504,753

[22] Filed: Jul. 19, 1995

[51] Int. Cl.[6] ..... B65D 35/00

[52] U.S. Cl. ..... 426/112; 426/115; 426/123; 426/131; 426/392; 426/394; 426/397; 206/217; 206/457; 206/459.1

[58] Field of Search ..... 426/112, 115, 426/123, 131, 392, 394, 397; 206/217, 457, 459.1; 215/6, 227

[56] References Cited

U.S. PATENT DOCUMENTS

| | | | |
|---|---|---|---|
| 3,656,654 | 4/1972 | Brinkley, III . | |
| 4,109,817 | 8/1978 | Payne et al. . | |
| 4,228,913 | 10/1980 | Mack et al. . | |
| 4,305,521 | 12/1981 | Komatsuta et al. . | |
| 4,356,927 | 11/1982 | Cooper et al. . | |
| 4,537,324 | 8/1985 | Wang . | |
| 4,690,294 | 9/1987 | Jones . | |
| 4,709,829 | 12/1987 | Johnson et al. . | |
| 4,728,001 | 3/1988 | Serba . | |
| 4,826,034 | 5/1989 | Forbes . | |
| 4,892,187 | 1/1990 | Stein . | |
| 4,911,320 | 3/1990 | Howes . | |
| 4,923,083 | 5/1990 | Forbes . | |
| 4,923,084 | 5/1990 | Forbes . | |
| 5,046,631 | 9/1991 | Goodman . | |
| 5,056,659 | 10/1991 | Howes et al. . | |
| 5,056,681 | 10/1991 | Howes . | |
| 5,099,232 | 3/1992 | Howes | 340/815.21 |
| 5,172,827 | 12/1992 | Chang et al. . | |
| 5,439,103 | 8/1995 | Howes | 206/217 |
| 5,482,158 | 1/1996 | Plester | 206/271 |

FOREIGN PATENT DOCUMENTS

| | | |
|---|---|---|
| 0079673 | 10/1982 | European Pat. Off. . |
| 0078789 | 11/1982 | European Pat. Off. . |
| 0444385 | 5/1990 | European Pat. Off. . |
| 0482776 | 10/1991 | European Pat. Off. . |
| 2217677 | 11/1989 | United Kingdom . |
| 2237789 | 5/1991 | United Kingdom . |
| 8901750 | 3/1989 | WIPO . |
| 9500414 | 1/1995 | WIPO . |

*Primary Examiner*—Steven Weinstein
*Assistant Examiner*—Curtis E. Sherrer
*Attorney, Agent, or Firm*—Birch, Stewart, Kolasch & Birch, LLP

[57] ABSTRACT

A container assembly for housing liquid products and a prize therein which may be distributed with non-prize bearing containers comprising: a can for containing the liquid product in an interior chamber thereof, and a prize-holding subassembly positioned within the interior chamber for retaining a prize therein. The prize holding subassembly includes a tether for supporting the prize assembly. The tether includes a hair-pin shaped spring portion defining legs, and foot portions extending from those legs. A proximal end of the tether on one of the foot portions engages a gate on the underside of the can closure, and compresses the spring portion into a cocked, position. When the closure is opened, the gate releases the proximal end of the tether so that it may pop up through the open end of the can for gripping by the consumer. A distal end of the tether on the other end of the tether supports a prize container which is manually removable from the can with the tether.

51 Claims, 4 Drawing Sheets

PRIZE-CONTAINING BEVERAGE CAN

BACKGROUND OF THE INVENTION

The present invention relates to a container assembly for housing liquid products and a prize therein which may be distributed with non-prize bearing containers. More specifically, the present invention relates to a prize-holding subassembly for insertion into a beverage can which is light-weight, self-securing and accurately positionable therein.

A device, which delivers a prize on opening a beverage can, has significant promotional advantages. Such a device is described by Howes (U.S. Pat. No. 5,056,659), but relies on a system which requires that the device be welded, or glued, to the can-end. Other known devices usually rely on some means of fixing the device to the can end, such as by welding. Welding requires ends with specially-coated undersides, which preclude using the device in conjunction with the normal ends. Since the device must be mixed into the normal production of beverage cans, the need to use special can ends is disadvantageous, since this could provide a clue as to the cans containing prizes.

In some known devices the prizes are presented to the open end of the can by either a complex spring assembly, or by buoyant force of the beverage, in response to opening of the can closure. Such devices often have a relatively large number of parts including guide tubes through which the prize is propelled by the springs or buoyant force.

Additionally, misalignment in some known devices can result in the jamming, or non-opening of the can end, with the result that consumer access is prevented. Failure of the device should not only be rare, but should not prevent that the beverage is accessed and drunk normally.

SUMMARY OF THE INVENTION

Accordingly, it is a primary object of this invention to provide a prize-delivering device for insertion into a beverage can, which avoids the limitations of previous devices, and particularly:

(1) Enables use of materials for the device, all of which are compatible with the beverage, so that the can may contain both the prize and a consumable beverage.

(2) Avoids welding, or other means, which limit application to a special can end.

(3) Ensures that misalignment, or other errors in installing the device in the can, cannot lead to failure of the consumer to access the beverage.

(4) Provides a system which cannot be detected before opening (e.g. by attempting to shake or rattle the prize within the can).

(5) Provides a system, which can be easily applied in a can filling line, without spillage, and without the need for special equipment (except possibly for inserting the prize holders into the cans, which can also be achieved manually).

(6) Provides a container assembly with a simple construction, with few parts, to enhance reliability of the prize-delivery function.

(7) Provides a container assembly with a prize presentation assembly having a smaller volume and fewer parts in order to reduce the impact on product integrity and product contents.

(8) Provides a prize presentation assembly which does not depend on buoyant forces generated by the liquid product so that operation of the prize presentation assembly is independent of the state and volume of the product.

(9) Provides a prize presentation assembly which presents only a small single piece element through the can opening so that the size of the can opening and its opening function are not critical.

(10) Provides a prize presentation function which does not encourage consumers to put fingers within the can.

(11) Provides a prize presentation assembly which is readily adaptable to different height cans.

(12) Provides a prize presentation assembly wherein the end of the assembly pops up upon opening of the can creating an increased surprised effect.

The objects of the present invention are fulfilled by providing a container assembly for housing liquid products and a prize, comprising:

a can for containing the liquid product, said can having an open end, a closed end and sidewalls connecting the open and closed ends, said sidewalls having interior surfaces defining an interior chamber;

closure means for opening and closing the open end of the can;

a tether having a proximal end adjacent the closure means and a distal end connected to the prize assembly for supporting the prize assembly within a storage position in the interior chamber; and prize presentation means for exposing the proximal end of the tether in juxtaposed relationship with the open end of the can in response to opening of the closure means;

the proximal end of the tether being engageable by a consumer to manually withdraw the prize assembly from the can.

The tether has a hair-pin shaped spring portion which is compressed or cocked in a stored position within the can until the closure means is opened. The hair-pin shaped portion includes a pair of spaced legs joined by a continuous bend and a pair of foot portions extend from the respective legs. The end of one of the foot portions defines the proximal end of the tether which is normally disposed adjacent to and on the underside of the closure in a biased condition toward the closure affected by the hair-pin shape spring portion. The other foot extends from one of the legs of the hair-pin shaped spring to form the distal end of the tether which is secured to one end of a prize assembly.

A gate or latch is provided on the underside of the closure. The gate normally holds the proximal end of the tether within a storage position in the interior chamber of the can prior to opening of the closure. When the closure is opened the gate moves out of engagement with the proximal end of the tether, thereby permitting the proximal end of the tether to pop up through the open end of the can so that it is visible and accessible to a consumer.

The tether including the foot portions is supported within a guide slot. The guide slot includes appropriate stops for precluding the tether from complete ejection from the can under the force of the spring; but permitting the tether to be gripped by a consumer and pulled out of the can with the attached prize assembly by a manual force.

The closure means includes a two-piece construction including an outer disk which is a conventional can end including a conventional pull-tab opener and associated frangible panel. This conventional can end, or disk, overlies an inner disk which supports the gate and guide assembly for the tether. The peripheral portions of the inner disk are bent over the open end of the can flange and sandwiched between the overlying periphery of the can end and the peripheral flange of the can.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given byway of illustration only, and thus, are not limitative of the present invention and wherein.

DETAILED DESCRIPTION OF PREFERRED EMBODIMENTS

Figure 1:
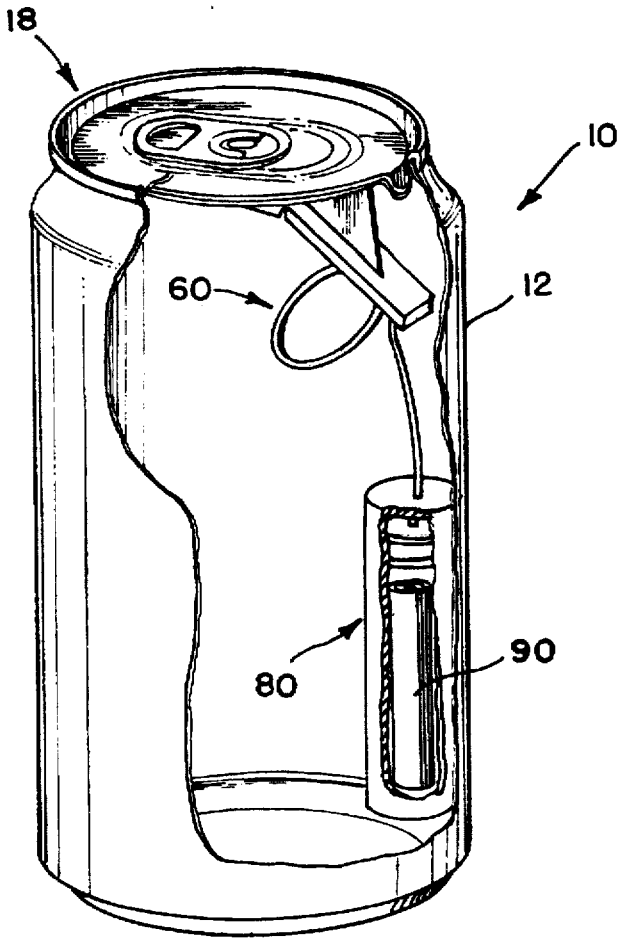
FIG. 1 is a top front perspective view of a can end assembly of the present invention with a portion broken away to illustrate the position of the prize assembly of the present invention therein.

Referring to the drawings there is illustrated a can assembly 10 having cylindrical sidewalls 12 defining an interior chamber therebetween. A closed bottom end 13 and an open top end 14. Open top end 14 terminates in a peripheral flange or curl 16.

The open end 14 is closable by a conventional can end assembly 18 which includes an annular groove 20 and a peripheral curl 22. Peripheral curl 22 in a conventional can end construction is bent over flange 16 of the can sidewalls forming a seal about the periphery of the open end 14 of the can. Also provided on the can end assembly is a conventional pull tab 26 riveted or appropriately secured at 28 to the central disk 24 of the end assembly. A frangible panel 32 is formed in disk 24, and as is well known in the art, frangible panel 32 is ruptured and forced into the interior of the can when the tab 26 is lifted and the cam surface 30 on one end thereof presses down against panel 32.

The prize assembly of the present invention is supported on an inner disk 34 having an aperture 35 through which panel 32 may pass when the closure is opened by actuation of the pull tab 26. Disk 34 includes an annular groove 36 in which the underside of peripheral groove 20 from can end assembly 18 seats when can end assembly 18 and disk 34 are secured together by bending their peripheral ends 22 and 38, respectively, around the flange 16 of the can. Accordingly, the prize assembly support disk 34 may be readily assembled along with the can end during a conventional can filling process in which a large number of cans are rapidly filled and assembled in an in-line manner.

Figure 2:
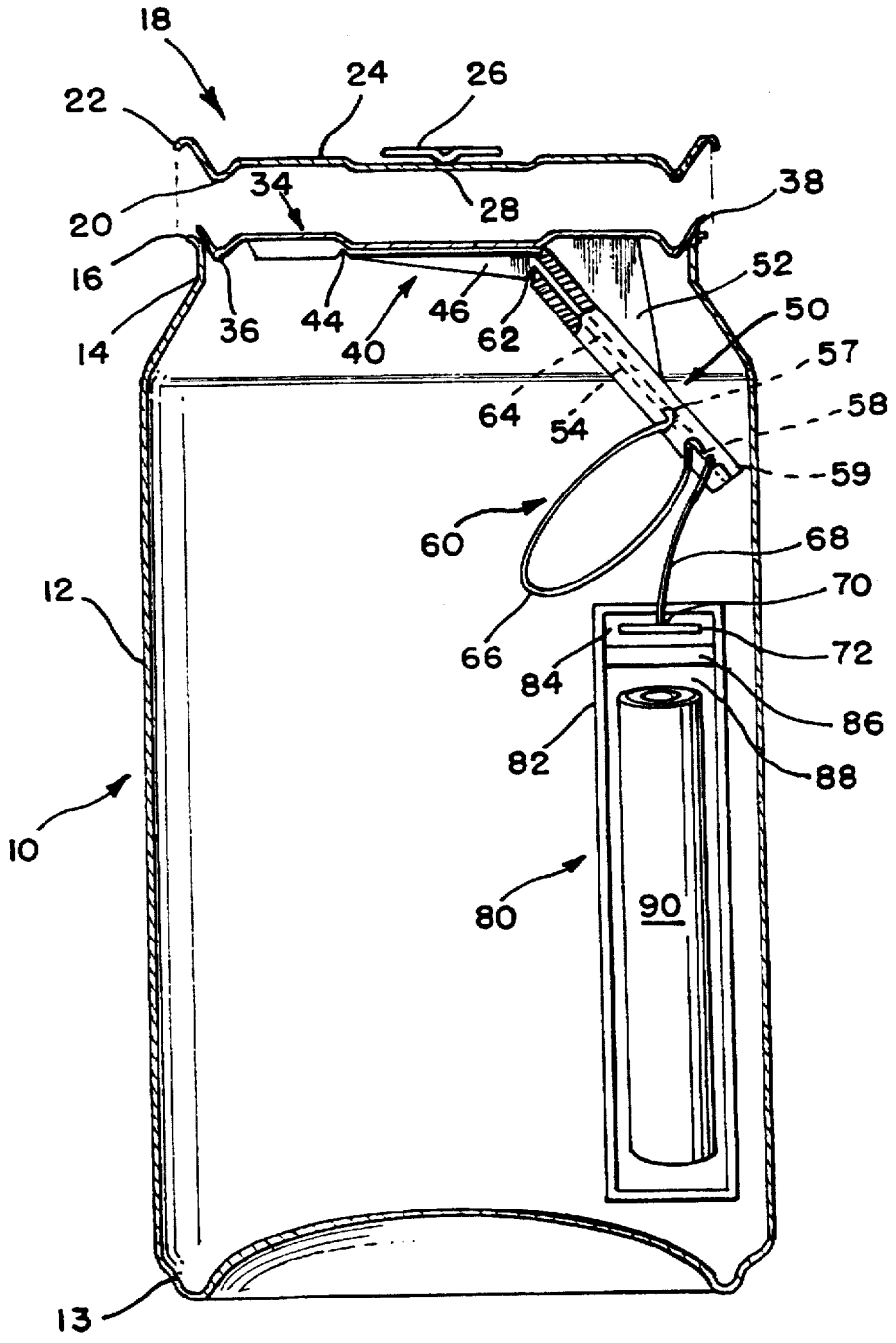
FIG. 2 is a side elevational view in cross section of the can assembly of FIG. 1 with the top closure means separated in an exploded view to illustrate, the manner in which the can end and associated prize assembly of the present invention are secured together, as well as the storage position of the prize assembly within the can before the closure means is opened.

The prize assembly of the present invention is also provided with a mouse-trap type gate or latch 40 secured to the underside of disk 34 and extending across aperture 35. The gate assembly is preferably a plastic strip including a base end 42 secured to the underside of disk 34 by spot welds adjacent to opening 35 and a hinge portion 44. However, if desired the gate may be integrally formed with the disk. Hinge 44 is formed by a groove in the underside of the plastic strip forming a living hinge. The gate element 46 includes a panel 46A extending across aperture 35, having a rib 46B on the underside thereof which stops just short of an end of the panel 46A in the provision of a notch 46C. Notch 46C is provided to engage with the proximal end 62 of a tether 60 to be further described hereinafter. As illustrated in FIG. 2 the notch 46C in the gate 40 holds the proximal end 62 of the tether in a storage or cocked position before the closure means is opened.

The tether 60 is preferably a wire rod or band of spring plastic or the like having a hair-pin shaped spring portion 66 defining a pair of legs which terminate in foot portions 64 and 68, respectively. Foot portion 64 connects proximal ends 62 thereof to one leg of the hair-pin shaped spring portion 66. Foot portion 68 connects the other leg to the distal end 70 of the tether. Distal end 70 is provided with an integral transverse tab 72 connected thereto which secures it to the end of prize assembly 80.

Tether 60 is mounted for storage and movement within a guide slot 54 of a guide assembly 50. Guide assembly 50 is secured to the underside of disc 34 by rib 52. A top end of guide assembly and associated slot 54 are juxtaposed to the aperture 35 in inner disk 34 and therefore, the overlying opening formed by frangible panel 32 in the can end. Guide assembly 50 angles outwardly and downwardly from opening 35 so that the prize assembly 80 on the end of tether 60 is supported near the periphery or sidewalls 12 of the can assembly.

The respective foot portions 64 and 58 are slidably mounted within slot 54. Protruding from the sidewalls of slot 54 are locking devices or stops 56 and 58. Transitional bends 57 and 59 are provided between the legs of the hair-pin shaped spring portion 66. Transitional bend 57 is engageable by stop or locking device 56 when the tether pops through the opening of the can to the position illustrated in FIG. 3. Transitional bend 59 is normally engaged by stops or locking devices 58 in both the storage position of FIG. 2 and the prize presenting position of FIG. 3. The force exerted on portions 57 and 59 of the tether 60 by these respective locking devices 56, 58 is sufficient to preclude the tether from complete ejection from the container under the force of the spring-shaped portion 66 upon opening of the closure. However, the ends of these locking devices 56, 58 are rounded and are sufficiently compressible so that when the proximal end 62 of the tether protruding from the can as illustrated in FIG. 3 is gripped by a consumer, the entire tether and attached prize assembly 80 may be manually pulled from the container through aperture 35 and the associated opening formed by the depression of panel 32 into the interior of the container.

Prize assembly 80 may include an outer sachet or cylinder 82 including a transverse panel 86 at the top thereof forming a chamber 84 in which transverse tab 72 is contained. Just below panel 86 within a chamber 88 is a prize 90 which may comprise a roll of currency or other type of prize such as a token, coupon etc. Sachet 82 may comprise a plastic bag heat-sealed at its edges.

Figure 3:
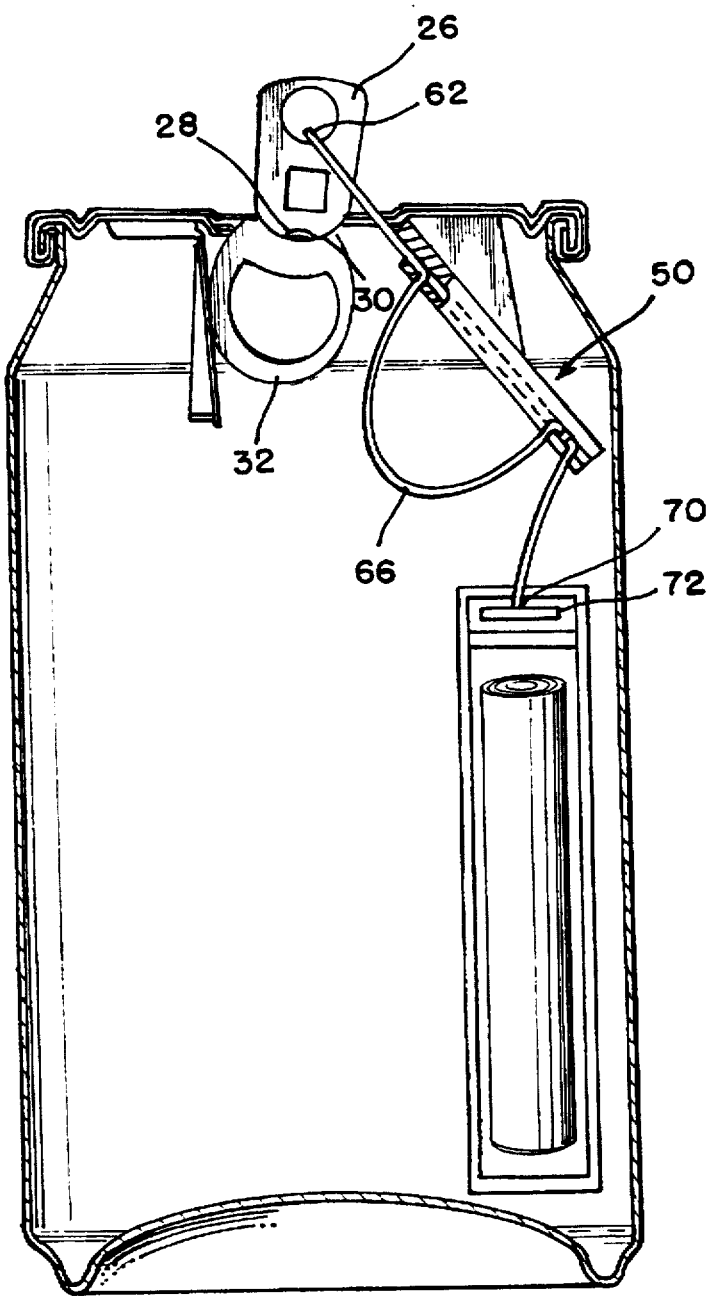
FIG. 3 is a side elevational cross sectional view of the can assembly of FIG. 1 illustrating the position of the prize presentation assembly with the closure means in an open position.
Figure 4:
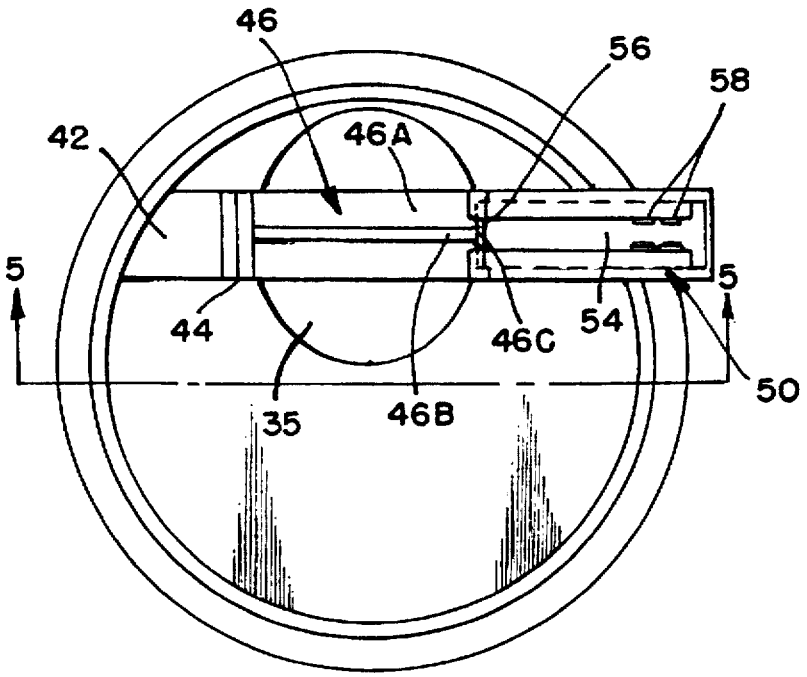
FIG. 4 is a bottom plan view of the inner disk of the closure means of the present invention and the prize presentation assembly secured to the underside thereof.
Figure 5:
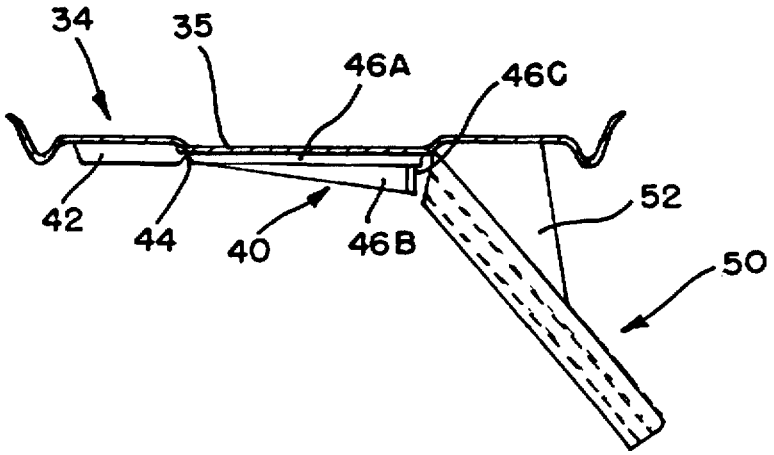
FIG. 5 is a side elevational view in cross section of the inner disk of the closure assembly of FIG. 4 taken along lines 5—5 thereof.

The operation of the prize presentation assembly of the present invention may be best understood by reference to FIG. 2 in conjunction with FIG. 3 which illustrate the prize assembly with the tether 60 and spring portion 66 in a cocked, stored position wherein the proximal end 62 of the tether is engaged within notch 46C of gate 46. As illustrated in FIG. 2 when tab 26 on the can end is lifted to depress frangible panel 32 into the interior of the can through aperture 35, panel 32 presses gate 46 downwardly about hinge 44 into the interior of the container and thereby releases the proximal end 62 of tether 60 through the can end. As illustrated in FIG. 3 the proximal end 62 is then accessible by a consumer for manual removal from the can along with the attached prize assembly 80. The end or any portion of tether 60 may be striped or colored in order to attract the consumer's attention when it pops up and protrudes through the open end of the can. Any appropriate color or surface ornamentation may be provided to attract the consumer's attention.

All parts of the prize assembly of the present invention including the disk 34, the gate 46, the tether 60, the guide 50 and the prize container 82 may be formed from lightweight plastic.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A container assembly for housing liquid products and a prize, comprising:

a can for containing the liquid product, said can having an open end, a closed end and sidewalls connecting the open and closed ends, said sidewalls having interior surfaces defining an interior chamber;

closure means for closing the open end of the can, the closure means being movable from a closed position to an open position;

a tether having a proximal end adjacent the closure means and a distal end connected to a prize assembly for supporting the prize assembly within a storage position in the interior chamber; and prize presentation means for exposing the proximal end of the tether in juxtaposed relationship with the open end of the can in response to opening of the closure means;

the proximal end of the tether being engageable by a consumer to manually withdraw the prize assembly from the can.

2. The container assembly of claim 1 further including spring means for biasing the proximal end of the tether toward said closure means.

3. The container assembly of claim 2 wherein said spring means comprises a portion of the tether.

4. The container assembly of claim 3 wherein said portion comprises a bend in the shape of a hair-pin with spaced legs.

5. The container assembly of claim 4 further including a first foot portion of the tether connecting the proximal end to one of said legs, and a second foot portion connecting the distal end to the other of said legs.

6. The container assembly of claim 5 further including guide slot means for slidably receiving the first and second foot portions therein, said guide slot means being oriented toward the open end of the container to thereby guide the proximal end of the tether toward said open end.

7. The container assembly of claim 6 further including stop means for limiting the movement of the proximal end of the tether in response to biasing force of the spring means, but permitting full removal of the tether in response to manual force applied by a consumer.

8. The container assembly of claim 2 further including stop means for limiting the movement of the proximal end of the tether in response to biasing force of the spring means, but permitting full removal of the tether in response to manual withdrawal by a consumer.

9. The container assembly of claim 3 further including stop means for limiting the movement of the proximal end of the tether in response to biasing force of the spring means, but permitting full removal of the tether in response to manual withdrawal by a consumer.

10. The container assembly of claim 2 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

11. The container assembly of claim 3 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

12. The container assembly of claim 4 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

13. The container assembly of claim 5 including a gate movable between a first position in which the gate engages and holds the proximal end of the tether within a storage position in the interior chamber, and to a second position out of engagement with the proximal end to permit the proximal end to move into exposed, juxtaposed relationship with the open end.

14. The container assembly of claim 6 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

15. The container assembly of claim 7 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

16. The container assembly of claim 1 wherein said closure means includes an inner disc connectable to the can sidewalls about the open end, an outer disc overlying the inner disc and closing the open end of the can, a frangible panel in the outer disc, and a pull-tab for bending the frangible panel into the interior chamber in response to application of a manual force thereto, said inner disc having an aperture therein for accommodating movement of the frangible panel therethrough and withdrawal of the prize assembly.

17. The container assembly of claim 16 wherein said tether and prize assembly are supported by the inner disc.

18. The container assembly of claim 2 wherein said closure means includes an inner disc connectable to the can sidewalls about the open end, an outer disc overlying the inner disc and closing the open end of the can, a frangible panel in the outer disc, and a pull-tab for bending the frangible panel into the interior chamber in response to application of a manual force thereto, said inner disc having an aperture therein for accommodating movement of the frangible panel therethrough and withdrawal of the prize assembly.

19. The container assembly of claim 18 wherein said tether and prize assembly are supported by the inner disc.

20. A method of assembling and using the container assembly of claim 1, the method comprising installing the prize assembly and tether in the interior chamber, closing the container assembly with the closure means and randomly distributing the container assembly amongst non-prize bearing containers.

21. A method of assembling and using the container assembly of claim 2, the method comprising installing the prize assembly and tether in the interior chamber, closing the container assembly with the closure means and randomly distributing the container assembly amongst non-prize bearing containers.

22. A method of assembling and using the container assembly of claim 3, the method comprising installing the prize assembly and tether in the interior chamber, closing the container assembly with the closure means and randomly distributing the container assembly amongst non-prize bearing containers.

23. A method of assembling and using the container assembly of claim 5, the method comprising installing the prize assembly and tether in the interior chamber, closing the container assembly with the closure means and randomly distributing the container assembly amongst non-prize bearing containers.

24. A method of assembling and using the container assembly of claim 6, the method comprising installing the prize assembly and tether in the interior chamber, closing the container assembly with the closure means and randomly distributing the container assembly amongst non-prize bearing containers.

25. A package for housing and dispensing consumable liquid products and a prize, comprising:

a can for containing the liquid product, said can having an open end, a closed end and sidewalls connecting the open and closed ends, said sidewalls having interior surfaces defining an interior chamber;

closure means and closing the open end of the can, the closure means being movable from a closed position to an open position;

a consumable liquid product disposed within said interior chamber;

a tether having a proximal end adjacent the closure means and a distal end connected to a prize assembly for supporting the prize assembly within a storage position in the interior chamber; and prize presentation means for exposing the proximal end of the tether in juxtaposed relationship with the open end of the can in response to opening of the closure means;

the proximal end of the tether being engageable by a consumer to manually withdraw the prize assembly from the can.

26. The package of claim 25 further including spring means for biasing the proximal end of the tether toward said closure means.

27. The package of claim 26 wherein said spring means comprises a portion of the tether.

28. The package of claim 27 wherein said portion comprises a bend in the shape of a hair-pin with spaced legs.

29. The package of claim 28 further including a first foot portion of the tether connecting the proximal end to one of said legs, and a second foot portion connecting the distal end to the other of said legs.

30. The package of claim 29 further including guide slot means for slidably receiving the first and second foot portions therein, said guide slot means being oriented toward the open end of the container to thereby guide the proximal end of the tether toward said open end.

31. The package of claim 30 further including stop means for limiting the movement of the proximal end of the tether in response to biasing force of the spring means, but permitting full removal of the tether in response to a manual force applied by a consumer.

32. The package of claim 26 further including stop means for limiting the movement of the proximal end of the tether in response to biasing force of the spring means, but permitting full removal of the tether in response to manual withdrawal by a consumer.

33. The package of claim 27 further including stop means for limiting the movement of the proximal end of the tether in response to biasing force of the spring means, but permitting full removal of the tether in response to manual withdrawal by a consumer.

34. The package of claim 26 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

35. The package of claim 27 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

36. The package of claim 28 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

37. The package of claim 29 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

38. The package of claim 30 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

39. The package of claim 31 further including a gate movable between a first position in which the gate engages and holds the proximal end of the tether within a storage position in the interior chamber, and to a second position out of engagement with the proximal end to permit the proximal end to move into exposed, juxtaposed relationship with the open end.

40. The package of claim 25 wherein said closure means includes an inner disc connectable to the can sidewalls about the open end, an outer disc overlying the inner disc and closing the open end of the can, a frangible panel in the outer disc, and a pull-tab for bending the frangible panel into the interior chamber in response to application of a manual force thereto, said inner disc having an aperture therein for accommodating movement of the frangible panel therethrough and withdrawal of the prize assembly.

41. The package of claim 40 wherein said tether and prize assembly are supported by the inner disc.

42. The package of claim 26 wherein said closure means includes an inner disc connectable to the can sidewalls about the open end, an outer disc overlying the inner disc and closing the open end of the can, a frangible panel in the outer disc, and a pull-tab for bending the frangible panel into the interior chamber in response to application of a manual force thereto, said inner disc having an aperture therein for accommodating movement of the frangible portion therethrough and withdrawal of the prize assembly.

43. The package of claim 42 wherein said tether and prize assembly are supported by the inner disc.

44. A method of assembling and using the package of claim 25, the method comprising installing the prize assembly and tether in the interior chamber, closing the can with the closure means and randomly distributing the package amongst non-prize bearing packages.

45. A method of assembling and using the package assembly of claim 26, the method comprising installing the prize assembly and tether in the interior chamber, closing the can with the closure means and randomly distributing the package amongst non-prize bearing packages.

46. A method of assembling and using the package of claim 27, the method comprising installing the prize assembly and tether in the interior chamber, closing the can with the closure means and randomly distributing the package amongst non-prize bearing packages.

47. A method of assembling and using the package of claim 29, the method comprising installing the prize assembly and tether in the interior chamber, closing the can with the closure means and randomly distributing the package amongst non-prize bearing packages.

48. A method of assembling and using the package of claim 30, the method comprising installing the prize assembly and tether in the interior chamber, closing the can with the closure means and randomly distributing the package amongst non-prize bearing packages.

49. A prize presentation assembly for insertion into the open end of a beverage can comprising:

a tether having a proximal end adjacent a closure means and a distal end connected to the prize assembly for supporting the prize assembly within a storage position in the interior changer;

said tether having a spring portion in the shape of a hair-pin with spaced legs, one of said legs being connected by a first foot portion to said proximal end, the other leg being connected by a second foot portion to said distal end;

a disc connectable to the open end of the beverage can, said disc having an aperture through which the proximal end of the tether may be presented for manual engagement by a consumer; and guide slot means for slidably receiving the first and second foot portions therein, said guide slot means being oriented toward the open end of the can and the aperture in the disc to thereby guide the proximal end of the tether toward said open end, said guide slot means being secured to said disc.

50. The prize presentation assembly of claim 49 further including stop means for limiting the movement of the proximal end of the tether in response to biasing force of the spring means, but permitting full removal of the tether in response to a manual force applied by a consumer.

51. The prize presentation assembly of claim 50 further including a gate movable between a first position in which the gate engages and holds the proximal end of the tether within a storage position in the can and to a second position out of engagement with the proximal end to permit the proximal end to move into exposed, juxtaposed relationship with the open end of the can.

* * * * *